US006082965A

United States Patent [19]

Morando

[11] Patent Number: 6,082,965

[45] Date of Patent: Jul. 4, 2000

[54] ADVANCED MOTOR DRIVEN IMPELLER PUMP FOR MOVING METAL IN A BATH OF MOLTEN METAL

[75] Inventor: Jorge A. Morando, Cadiz, Ky.

[73] Assignee: Alphatech, Inc., Cadiz, Ky.

[21] Appl. No.: 09/398,272

[22] Filed: Sep. 20, 1999

Related U.S. Application Data

[62] Division of application No. 09/130,937, Aug. 7, 1998.

[51] Int. Cl.[7] ..... F04D 7/00

[52] U.S. Cl. ..... 415/200; 415/213.1; 415/215.1

[58] Field of Search ..... 415/200, 213.1, 415/215.1, 214.1; 416/241 B; 417/424.1, 423.15, 423.3

[56] References Cited

U.S. PATENT DOCUMENTS

| | | | |
|---|---|---|---|
| 3,776,660 | 12/1973 | Anderson et al. | 415/196 |
| 5,558,505 | 9/1996 | Mordue et al. | 417/360 |
| 5,944,496 | 8/1999 | Cooper | 417/423.3 |

*Primary Examiner*—Edward K. Look
*Assistant Examiner*—Ninh Nguyen
*Attorney, Agent, or Firm*—Charles W. Chandler

[57] ABSTRACT

An apparatus for moving a stream of molten metal in a bath of molten metal having a housing and steel alloy legs to prevent the housing from rising in the molten metal. The steel legs are protected by tubular shields made of a heat resistant material. The shields each has a lower end attached to the housing and has an inner diameter that is larger than the leg's outer diameter to accommodate the thermoexpansion of the leg. Inert gas is introduced in the space between the steel leg and the shield to form an oxygen-free environment around the leg.

8 Claims, 9 Drawing Sheets

ADVANCED MOTOR DRIVEN IMPELLER PUMP FOR MOVING METAL IN A BATH OF MOLTEN METAL

This application is a division of application Ser. No. 09/130937, filed Aug. 7, 1998, (status, abandoned, pending, etc.).

BACKGROUND OF THE INVENTION

This invention is related to mechanical pumps for moving or pumping metal such as aluminum or zinc in a bath of molten metal, and more particularly to such a pump in which a motor supported above the bath drives a vertical stainless steel shaft. The lower end of the shaft drives the impeller to create a stream of molten metal. A ceramic sleeve shields the stainless steel shaft to protect it from the corrosive effects of the heated molten metal, as well as forming a loose fit with the shaft to accommodate differences in the thermal expansion characteristics between the ceramic and the stainless steel.

Mechanical power driven pumps for moving metal in a bath of molten metal conventionally have a relatively short life because of the destructive effects of the molten metal on the pump components. If the pump shaft connecting the motor to an impeller is formed of any steel to provide sufficient torque to move the impeller in the molten metal, the steel has a short life because it is chemically attacked by the molten metal. If the steel shaft is shielded by a protective coating of a ceramic material, then the different thermal expansion characteristics of the steel and the ceramic causes the ceramic to shatter in a relatively short time.

A shaft made of graphite alone will burn at the metal surface. A shaft made of ceramic alone does not have sufficient tensile, torque or impact strength to overcome the stresses normally encountered when pumping molten metal.

A pump housing submerged in molten metal and made of graphite or ceramic material to withstand the heat, tends to rise in the metal bath because the ceramic has a lower density than the metal. In order to prevent the pump housing from rising in the metal, it is desirable to mount a series of vertical legs between the pump housing and an overhead supporting structure. In addition the legs (or posts as they are also called) should be strong enough to overcome the tensile stresses created during installation and subsequent removal of the pump in the molten metal bath. Such legs experience problems similar to that of an unshielded pumping shaft, that is, if they are made of an uncoated steel they have a short life because the steel is attacked by the molten metal. If they are made entirely of graphite, the legs will burn at the metal interface. If a leg is made entirely of a ceramic material having good heat resistant characteristics, it has insufficient tensile strength to ensure a long life.

SUMMARY OF THE INVENTION

The broad purpose of the present invention is to provide a shielded stainless steel driving shaft for a centrifugal impeller-type pump immersed in a molten metal bath.

Another object of the invention is to provide an improved stainless steel leg (post) for supporting and preventing the pump housing from rising in the molten metal.

Still another object of the invention is to provide an improved static inlet filter configuration for an impeller pump immersed in a molten metal bath.

Still another object of the invention is to provide a ceramic shield surrounding a graphite leg and forming an inert gas chamber around the leg. An inert gas is delivered to the gas chamber to provide an oxygen-free environment around those graphite components of the leg that may tend to burn at the temperatures of the surface of the molten metal bath.

Still another object of the invention is to provide a dynamic filter for the inlet opening of the impeller of a pump mounted in a molten metal bath. The filter rotates with the impeller without interfering with the pumping vanes. Slinger ribs provided on the dynamic filter deflect debris attempting to enter the strainer apertures to prevent their passage into the pump housing.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views and in which.

DESCRIPTION OF THE PREFERRED EMBODIMENT

Figure 1:
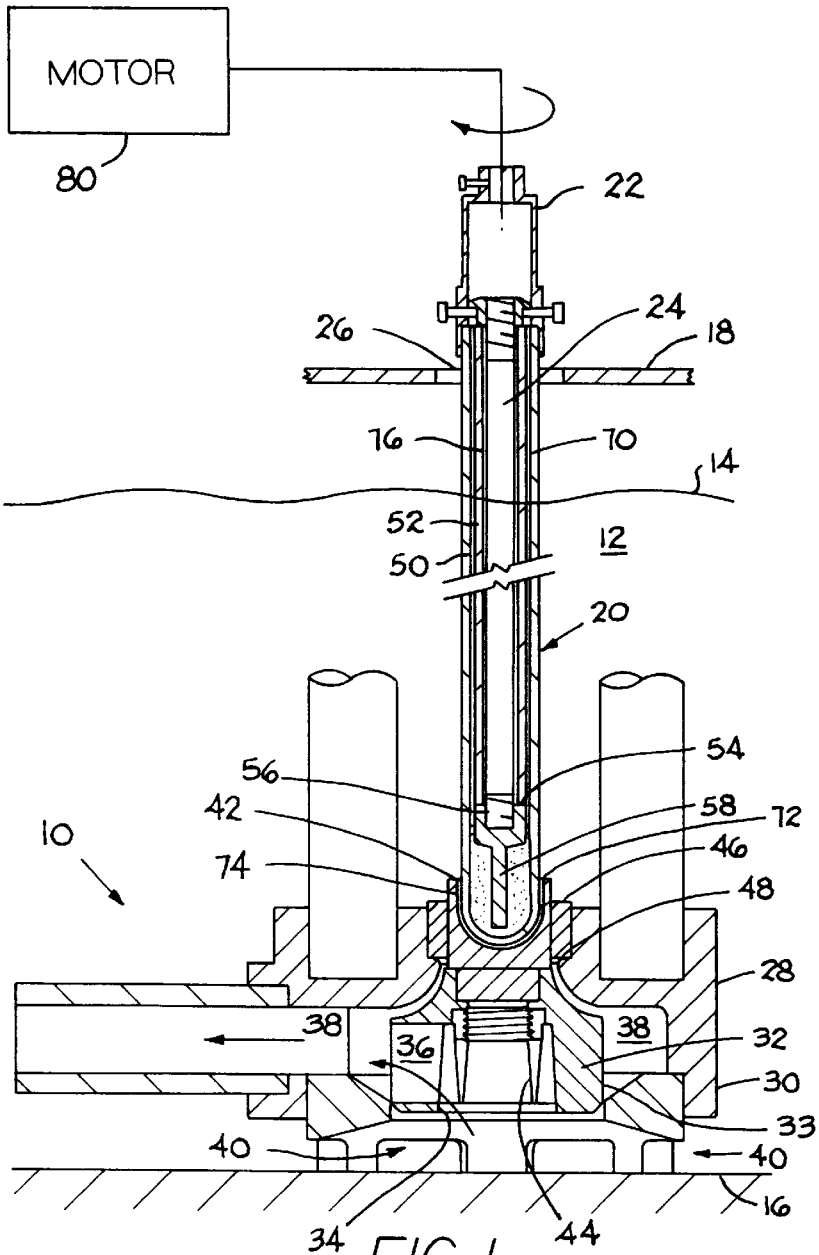
FIG. 1 is a longitudinal sectional view of an impeller pump immersed in a bath of molten metal and illustrating the preferred embodiment of the invention.

Referring to the drawings, FIG. 1 illustrates a preferred impeller pump 10 having a lower pumping end disposed in a bath of molten metal 12 such as aluminum. The bath has a top metal level 14. Typically the bath operates at a temperature not in excess of 1800° F. The bath is contained by a pot having a floor 16. An electrically driven motor 80 is supported in any suitable location above the pump cover plate 18, and is connected by a coupling 22 to a stainless steel pumping or driving shaft 24. The shaft is supported in an opening 26 in the pump cover plate. The shaft has a sufficient length that the upper end is supported above cover plate 18 and its lower end is disposed in the bath of molten metal 12.

A pump housing assembly 28 includes a housing 30 and a vane-type pumping member 32 disposed in the housing. The shaft is drivingly connected to the pumping member to rotate it in the housing in order to produce a stream of molten metal that enters the housing adjacent the floor of the pot through an inlet opening 34, into a pumping chamber 36 and toward an outlet opening 38 in the direction of arrows 40.

The pumping member includes a ceramic impeller 33 which carries pumping vanes 44. Bearing means 46 carried in a shoulder 48 of the housing 30 engage a ceramic end driver 42 cemented to a vertical outer tubular ceramic shield 50. The lower end of the end driver 42 is closed off and fits into pumping member 32. The upper end of the shield extends upwardly through cover plate 18. End driver 42, after cementing, forms a single integral part of shaft assembly 20 together with shield 50, tubular spacer shield 52, steel driving shaft 24 and tongue 58.

Inner ceramic tubular shield 52 is cemented to the inside of the outer shield 50. The upper end of the inner shield is flush with the upper end of the outer shield. The inner tubular shield is shorter than the outer shield to form an annular shoulder 54.

The lower end of the drive shaft 24 is threaded at 56 as illustrated in FIG. 1. The threaded end 56 extends below shoulder 54. A stainless steel tongue 58 is threadably mounted on threaded end 56 and seated on shoulder 54 in a manner that will be described.

Figure 2:
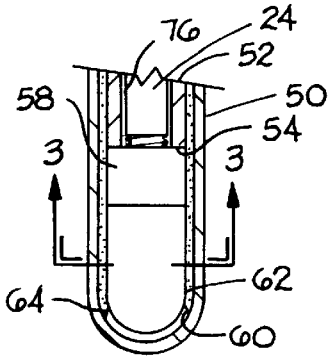
FIG. 2 is an enlarged view of the tongue carried on the lower end of the driving shaft for rotating the impeller.
Figure 3:
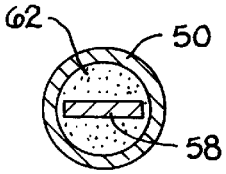
FIG. 3 is a view as seen along lines 3—3 of FIG. 2.

Referring to FIG. 2, the inside bottom of the outer shield forms a chamber 60. Tongue 58 is disposed in the chamber. Cement 62 is disposed in the chamber and has a socket 64 generally corresponding to the configuration of the tongue but slightly larger to provide for a clearance between the tongue and the socket to allow for thermal expansion differences.

As can be seen in FIG. 2, the bore 76 of the spacer shield 52 is larger than the diameter of the shaft 24 to provide a clearance which permits the shaft to expand in response to heat without creating an expansion tensile stress on the spacer shield 52. Similarly, the tongue has a clearance that permits it to expand in response to heat without creating an expansion interference stress with the cement.

Referring to FIG. 1, coupling 22 forms the connection between the motor shaft and the shield assembly 20 that rotates pumping member 32 with impeller vanes 44. The torque from the shaft is transmitted through the tongue to the body of cement to outer tubular shield 50 to the end driver 42, that is through the lower end of the shaft to the impeller. The shaft has a sufficient torque characteristic for driving the impeller in molten metal.

The inner spacer shield is located to form an annular air chamber 76 between the shaft and the inner shield along its full length. The air chamber has a size chosen to permit the stainless steel shaft to fully expand in the bath of molten metal without applying any expansion pressure on the ceramic shield. The shaft is then fully shielded by heat-resistant and molten metal resistant ceramic.

Figure 4:
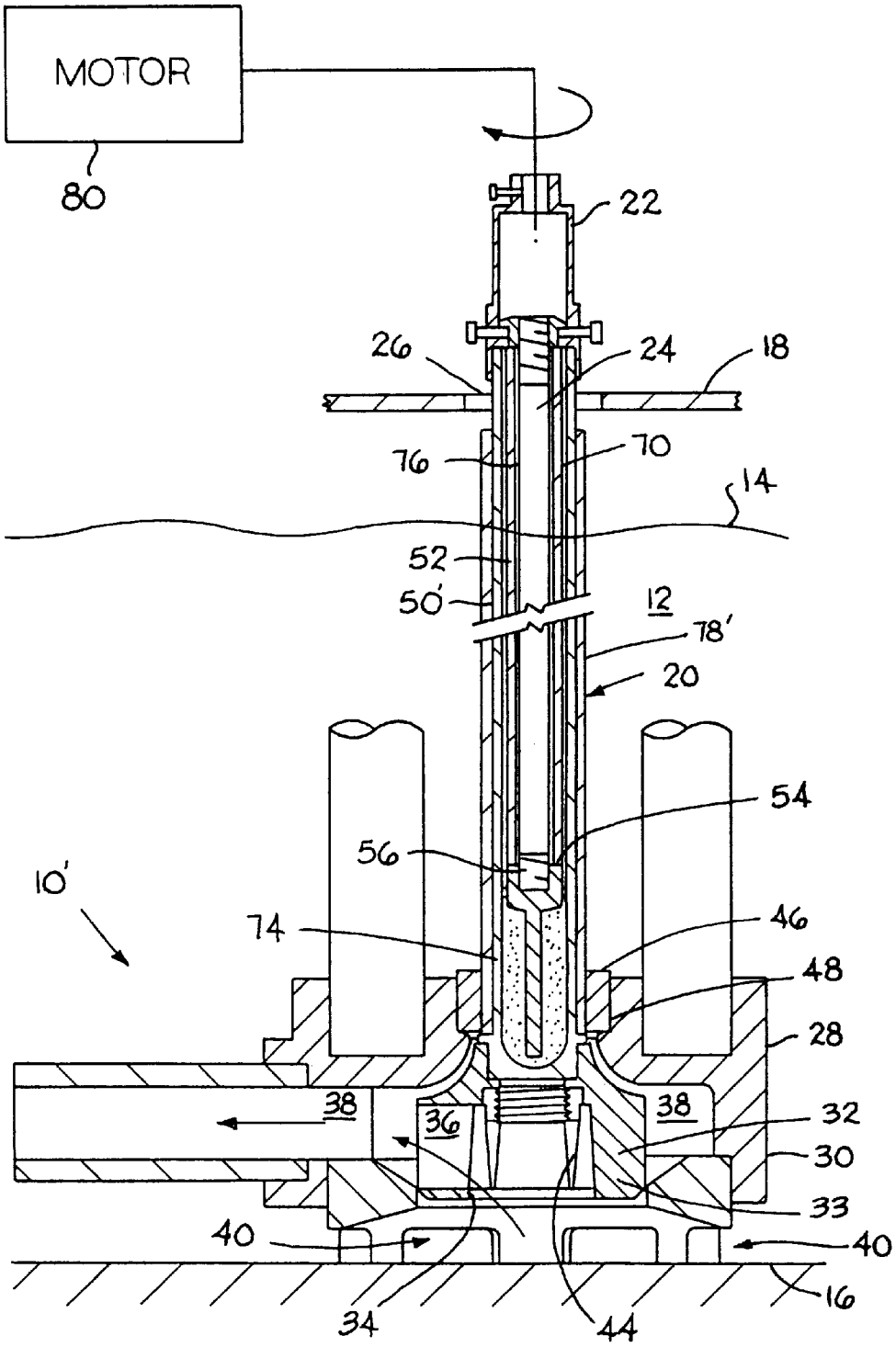
FIG. 4 is a longitudinal sectional view of an impeller pump immersed in a bath of molten metal and illustrating a graphite quill shaft design with an external ceramic shield protection.

FIG. 4 illustrates a modified impeller pump 10'.

Bearing means 46 carried in a shoulder 48 of the housing 30 engage an inner graphite sleeve-like shield 50'. The lower end of shield 50' is closed off and fits into pumping member 32. The upper end of shield 50' extends upwardly through cover plate 18. inner shield 50' is cemented to a protective ceramic sleeve 78' to form a single integral part of shaft assembly 20 together with, spacer shield 52, steel driving shaft 24 and tongue 58.

Figure 5:
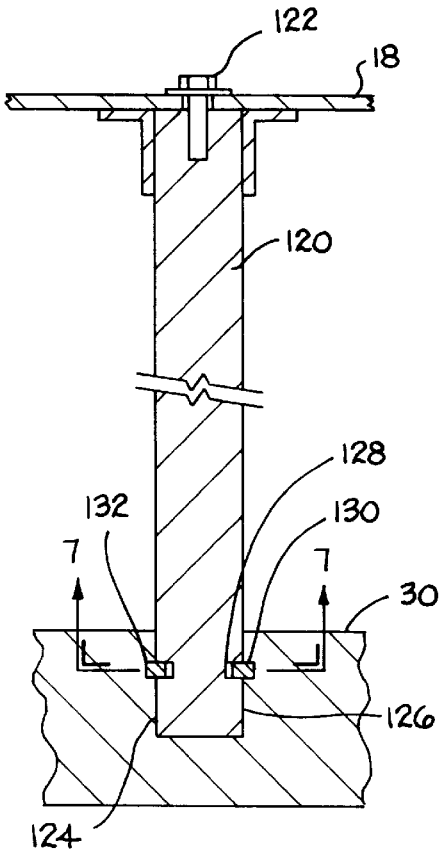
FIG. 5 is a view of an unshielded leg used for connecting a pump housing to an overhead structure.
Figure 6:
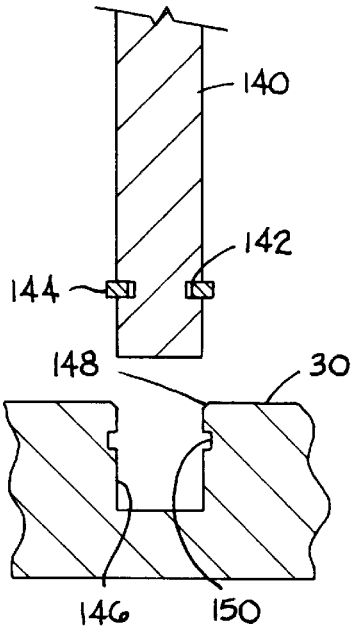
FIG. 6 is a view illustrating a split ring employed for connecting the lower end of the leg to the pump housing.
Figure 7:
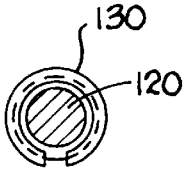
FIG. 7 is an enlarged view as seen along lines 7—7 of FIG. 5.

FIGS. 5–6 show various forms of an unshielded vertical leg that can be mounted between the pump housing 30 and cover plate 18 in order to lock the pump legs to the pump housing without the use of load-carrying cements, eliminating the need for large clearances between the legs and post sockets. Graphite cement is used only as a sealant to prevent molten metal penetration.

Graphite leg 120 has an upper end fastened to the cover plate by a threaded fastener 122. The lower end of the leg is received in a cylindrical socket 124 in the pump housing. The leg's lower end has an annular enlargement 126 which is bottomed in the socket. The leg has an annular groove 128 above the enlargement for receiving a close fitting split ring 130. The socket also has an annular groove 132 for receiving the split ring.

In this embodiment of the invention, the lower end of the leg is inserted into the socket by squeezing the split ring into groove 128. Once the split ring is disposed in the socket, the shaft is pushed down until the split ring snaps into groove 132 thereby being disposed in both the groove in the leg and the groove in the socket, locking the leg in position.

FIG. 6 illustrates another embodiment of the invention in which a vertical leg 140 has an annular groove 142 for receiving a close fitting split ring 144. The pump housing 30 has a socket 146. The upper edge of the socket is chamfered as at 148 in such a manner that as the leg is inserted into the socket, the chamfered edge squeezes the split ring into the groove 142. The leg is moved further into the socket until the split ring is partially expanded into the annular groove 150 in the socket. The split ring is disposed in both the socket of the leg and the groove of the socket thereby locking the leg to the housing.

Figure 8:
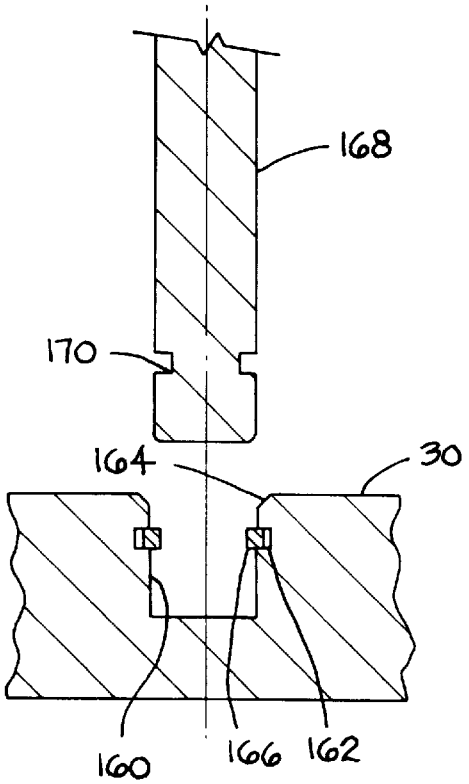
FIG. 8 is a view of another arrangement for connecting the support leg to the pump housing.

In FIG. 8, housing 30 has a generally cylindrical socket with a radial groove 162. The upper wall of the groove is adjacent a chamfered lip 164. Split ring 166 is placed in groove 162. When leg 168 is pushed into socket 160, ring 166 will expand, then snap into groove 170.

Figure 8A:
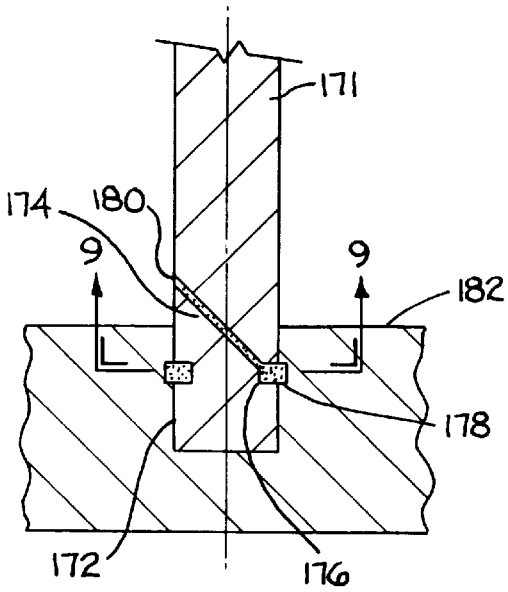
FIG. 8A is a view of a graphite leg for supporting the pump housing, utilizing graphite cement for connecting the lower end of the leg to the pump housing.
Figure 9:
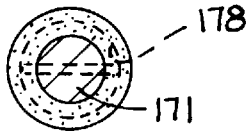
FIG. 9 is a view as seen along lines 9—9 of FIG. 8A.

FIGS. 8A and 9 illustrate another version of a leg-housing locking device. Leg 171 has a groove 178 connected by means of passage 174 to an opening 180 located above the upper surface of housing 182. Housing 182 has a socket 170 with an annular groove 176. After leg 171 is inserted in housing socket 172, graphite cement is injected under pressure in opening 180 and via passage 174 fills the cavity generated by grooves 176 and 178 in the housing and leg respectively, thus, preventing, after hardening, any axial displacement of the leg with respect to the housing.

Figure 10:
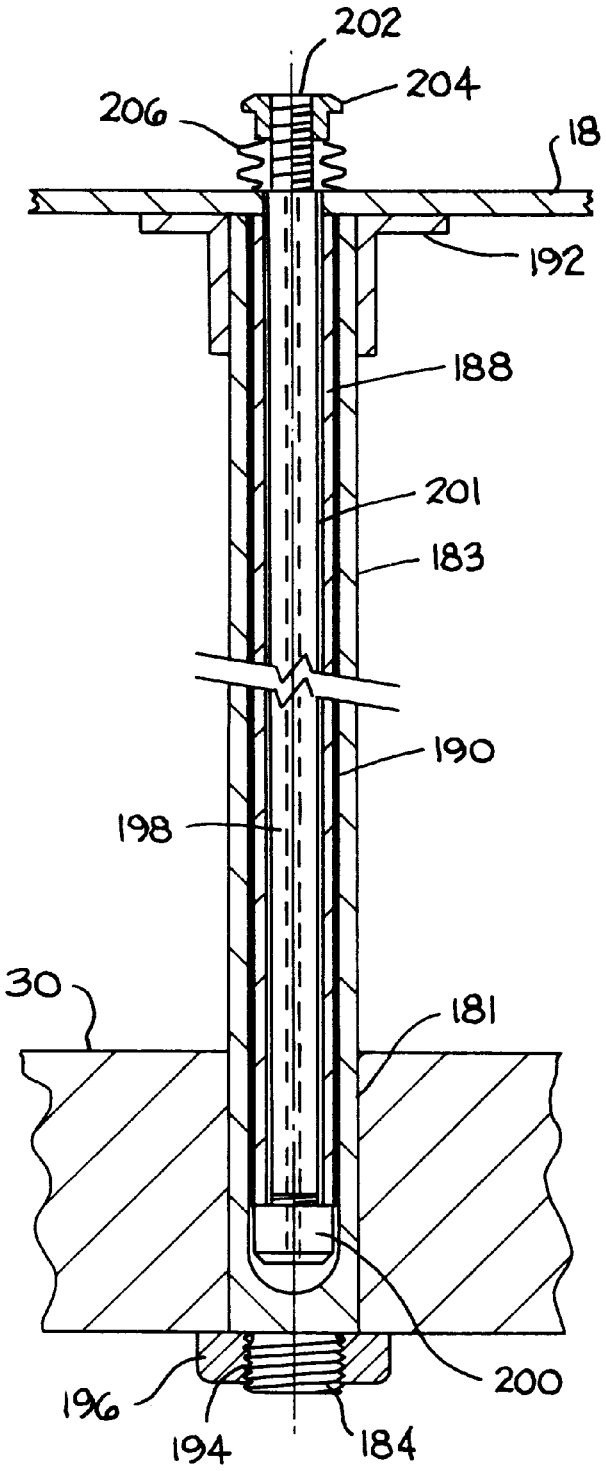
FIG. 10 is a view of a quill-shaft, ceramic support leg for the pump housing.

FIG. 10 illustrates a shielded upright quill leg for supporting pump housing 30 beneath a cover plate 18. An opening 181 is formed in housing 30. An outer ceramic tubular shield 183 is formed with a length sufficient so that its lower blind end extends below the inside surface of the wall of housing 30. The upper end abuts cover plate 18.

An inner ceramic tubular shield 188 is disposed inside the outer shield and cemented along the length and around the inner shield in the area 190 (indicated by the heavier line). The lower end of the inner shield extends above the bottom of the outer shield. The upper end of the outer shield is located by an annular mounting member 192 that is attached to the cover plate. The lower end of the outer shield is threaded at 194 to receive a locking nut 196 which is screwed up to abut the inside surface of the housing.

A stainless steel leg 198 is disposed in the inner shield. The lower end of the stainless steel leg has a radial enlargement 200 which has a diameter less than the inner diameter of the outer shield but greater than the inner diameter of the inner shield so that it abuts the lower edge of the inner shield. Leg 198 is located so as to form an annular chamber 201 between the leg and the inner shield to permit the leg to thermally expand when it is disposed in the molten metal bath, without imposing an expansion stress on the shields.

The upper end of the leg is threaded at 202 for receiving a locking nut 204 and bevel washer 206 in order to lock the leg in position when it has been properly located within the ceramic shield.

Figure 11:
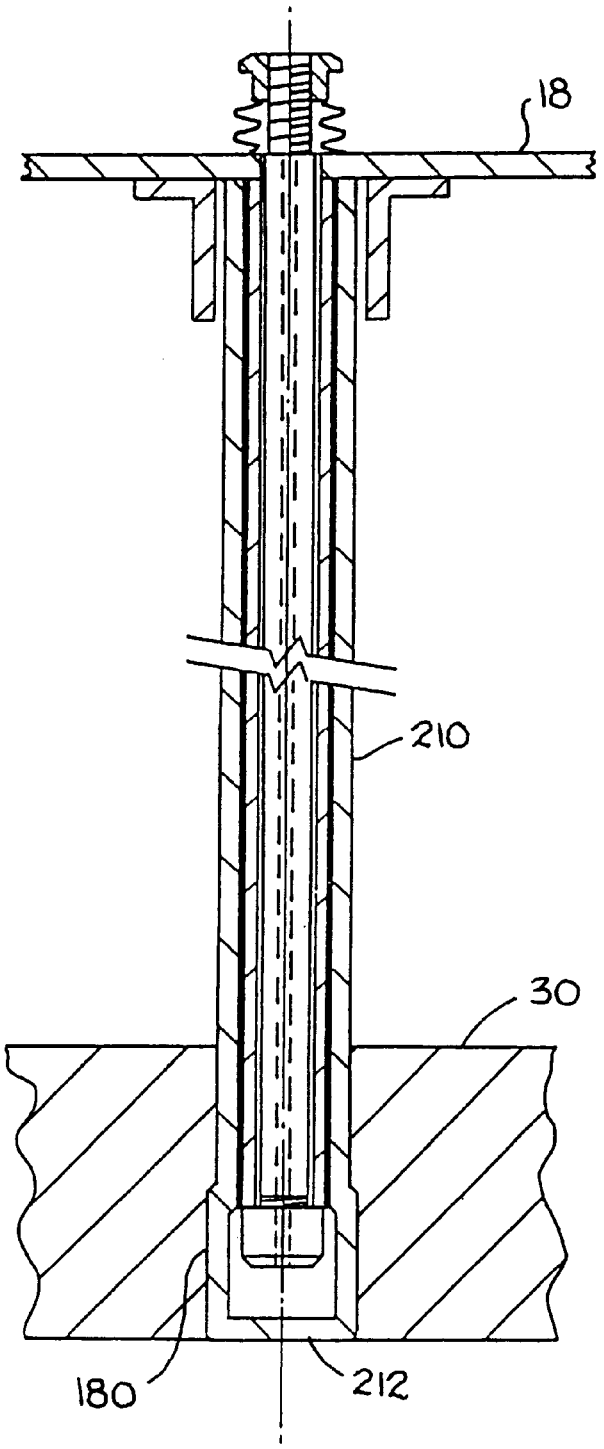
FIG. 11 is a view of another form of a quill-shaft, ceramic support leg for the pump housing.

FIG. 11 illustrates a slightly modified version of the shielded leg of FIG. 10. In this case a tubular shield 210 comprises inner and outer ceramic shields similar to those illustrated in FIG. 10, and an internal stainless steel leg. The lower end of the outer shield has an enlargement 212 sequestered inside a corresponding similar enlargement in the housing instead of using nut 196 with the threaded configuration.

Figure 11A:
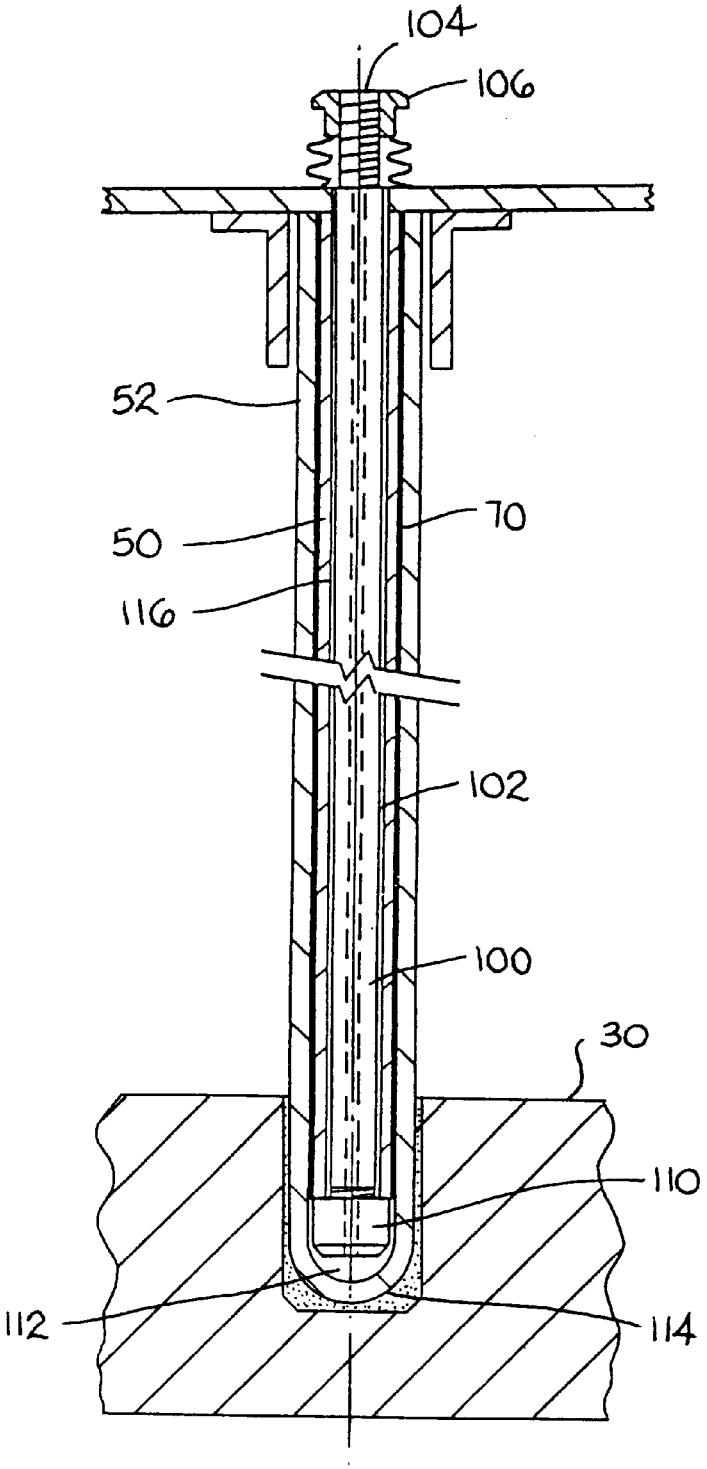
FIG. 11A is a view of another form of a quill-shaft ceramic or graphite support leg for the pump housing.

FIG. 11A illustrates a quill leg that is identical to that of FIG. 11 except that it has been cemented to pump housing 30 in accordance with common post-cementing procedures known by a person skilled in the art.

Figure 12:
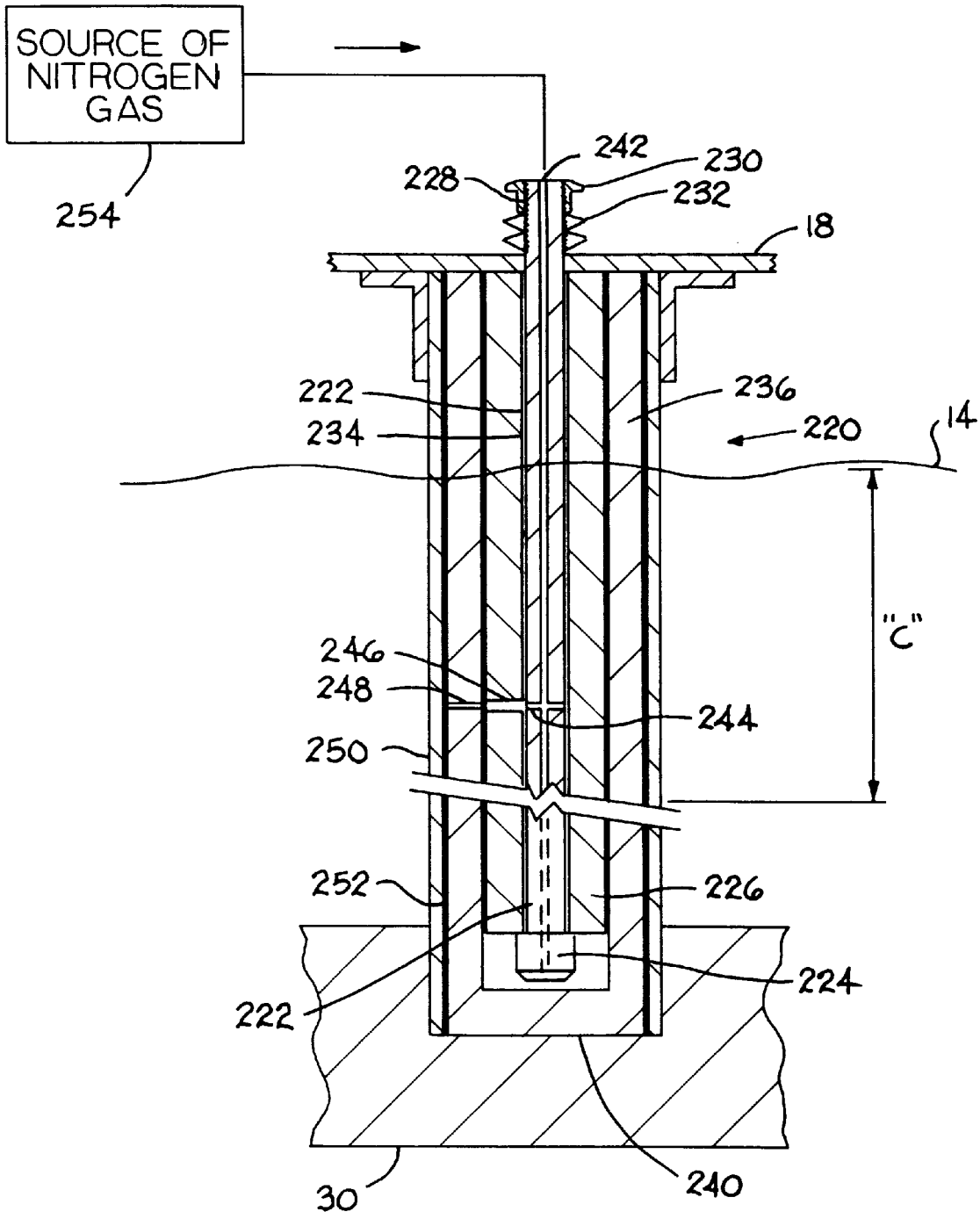
FIG. 12 is an enlarged fragmentary view of a graphite inert quill-shaft support leg for the pump, having an oxygen-free chamber to eliminate oxidation of the graphite components.

FIG. 12 illustrates another version of a shielded leg 220 for supporting pump housing 30 beneath cover plate 18. This particular design utilizes graphite components in combination with a ceramic outer sleeve to protect the graphite outer shield. Although the graphite components of the leg are protected by the heat resistant ceramic shield, in some cases the air chamber between them or air leakage provides sufficient oxygen to allow the support leg components to burn.

In this case, a stainless steel leg 222 has an enlargement 224 carried at its lower end mounted within an inner graphite tubular shield 226. The enlargement is seated against the lower end of the inner shield. The upper end of the leg is threaded at 228 to engage a fastening nut 230 and bevel washers 232 in such a manner that by tightening on nut 230, enlargement 224 firmly seats graphite shield 226 in position against the bottom of the cover plate to form a gas chamber 234 around leg 222.

An intermediate tubular graphite shield 236 telescopically receives the inner shield and has its internal surface cemented to the inner shield.

Leg 222 has a longitudinal gas passage 242 that extends from its upper end down to its lower end and also radially out through an opening 244 into chamber 234.

The inner shield, in turn, has a small passage 246 which communicates with a passage 248 in shield 236.

An outer ceramic tubular shield 250 encloses both of the graphite shields and has an internal annular chamber 252 in communication with passage 248. Chamber 252 is filled with molten metal resistant cement. A source of nitrogen 254 is connected to passage 242 to form an oxygen-free atmosphere around the leg as well as an oxygen-free atmosphere along and around the graphite shields exposed to the metal level to prevent the graphite shields from burning.

Figure 13:
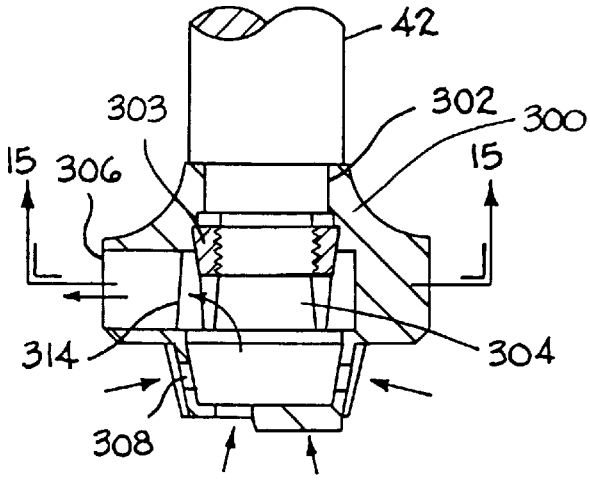
FIG. 13 is a sectional view of a dynamic strainer for the pump.
Figure 14:
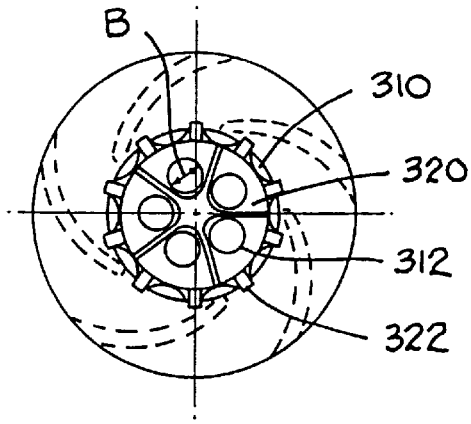
FIG. 14 is a bottom view of FIG. 13.
Figure 15:
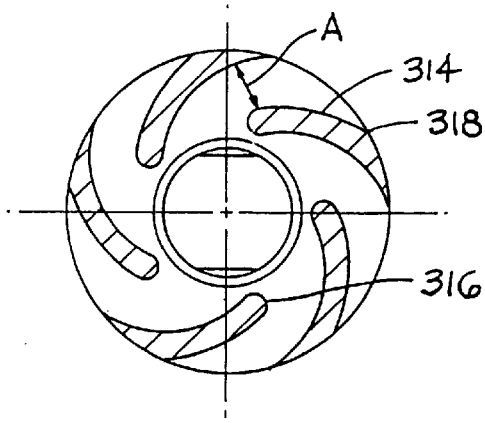
FIG. 15 is an enlarged view of the internal pumping vanes of the embodiment of FIG. 13.

FIGS. 13–15 illustrate a combination dynamic filter and pumping vane member 300 that may be substituted for the pumping member 32 illustrated in FIG. 1. Pumping vane member 300 has an opening 302 for receiving the lower threaded end of pumping shaft 42. A nut 303 attaches the body to the pumping member 300. Pumping member 300 thus rotates with driving shaft 24.

The pumping member has an internal chamber 304 with outlet opening means 306 and an apertured bottom strainer plate 308. The strainer plate has an annular outer series of openings 310 and an inner series of openings 312. The inner series of openings are in a bottom horizontal portion of the strainer plate while the outer inlet openings are in a frusto-conical wall.

Referring to FIG. 15, the pumping member has a series of pumping vanes 314 which are curved to form openings each having a width A in such a manner that as the pumping member is rotated, the pumping vanes draw the liquid metal through the inlet openings and then push the liquid metal out through the outlet opening means 306. Strainer openings 310 and 312 have a maximum diameter B that is smaller than the larger openings A between the vanes. Thus the strainer openings prevent debris having a size larger than strainer openings B from entering into the pumping chamber thereby preventing any clogging of the vane openings.

A series of inner linear radial slinger bars 320 and outer radial slinger bars 322 are mounted on the strainer plate between adjacent strainer openings to strike any relatively large debris attempting to enter the strainer openings before they reach the vane openings. The slinger vanes strike the debris thereby permitting the pump to be located closely adjacent the bottom of the molten metal pot thereby permitting a stream of inlet liquid metal to be generated at a lower level in the pot.

Thus, it is to be understood that several variations have been described of an improved impeller-type pump useful in molten metal baths as well as several variations of shielded legs for supporting the pump in the molten metal bath.

Having described my invention, I claim:

1. Apparatus for moving a stream of molten metal in a bath of the molten metal beneath overhead structure, comprising:

a pump housing adapted to be disposed in a bath of molten metal below the metal level;

leg means disposed between the pump housing and the overhead support structure, comprising:

a steel alloy leg having an upper end and a lower end, the leg having a sufficient compressive strength to prevent the pump housing from rising in the molten metal;

means for connecting the leg to the overhead support structure;

a tubular shield means enclosing at least a portion of the leg, and being formed of a material resistant to the heat of the molten metal; and the tubular shield means having a lower end attached to the pump housing, and an internal bore having a diameter greater than the diameter of the leg to accommodate the leg's thermal expansion caused by the heat in the molten metal bath.

2. Apparatus as defined in claim 1, in which the pump housing has an opening, the tubular shield has a lower end disposed in said opening, and structure on the lower end of the shield for preventing withdrawal of the shield through said opening.

3. Apparatus as defined in claim 2, in which said structure comprises a nut threadably mounted on the lower end of the shield.

4. Apparatus as defined in claim 2, in which the structure is an integral enlargement carried on the lower end of the shield, said enlargement being larger than the opening in the housing.

5. Apparatus as defined in claim 2, in which the tubular shield is made of a heat-resistant ceramic.

6. Apparatus as defined in claim 2, in which the shield means comprises an outer ceramic tubular shield, and an inner ceramic tubular shield telescopically received in the outer shield and cemented thereto, the inner shield being shorter than the leg whereby both ends of the leg extend beyond the ends of the inner shield, and upper fastener means are connected to the upper end of the leg and engageable with the upper end of the inner shield, and lower fastener means threadably fastened to the lower end of the leg and engaged with the lower end of the inner shield for cooperating with the fastener means in locating the leg in the bore of the inner shield.

7. Apparatus as defined in claim 6, in which the bore of the inner shield, and the leg form a gas chamber, and including means for introducing an inert gas into the gas chamber to form an oxygen-free environment around the leg.

8. An apparatus for moving a stream of molten metal comprising:

a pumping member;

a pump housing at least partially enclosing the pumping member;

a power device;

a shaft connecting the power device and the pumping member, said shaft having an elongated drive element and an elongated shield assembly, the shield assembly surrounding and forming a space between the drive element and the shield assembly sufficient to permit thermal expansion of the drive element;

an overhead support structure;

leg means disposed between the pump housing and the overhead support structure, comprising:

a steel alloy leg having an upper end and a lower end, the leg having a sufficient compressive strength to prevent the pump housing from rising in the molten metal;

means for connecting the leg to the overhead support structure;

a tubular shield means enclosing at least a portion of the leg, and being formed of a material resistant to the heat of molten metal; and the tubular shield means having a lower end attached to the pump housing, and an internal bore having a diameter greater than the diameter of the leg to accommodate the leg's thermal expansion caused by the heat in the molten metal;

said pumping member having an inlet opening and including vanes for moving molten metal, the vanes creating passages therebetween;

a strainer means mounted on said inlet opening, said strainer means having openings of a diameter narrower than the vane passages, and whereby debris larger than the strainer openings are removed from the molten metal before the metal passes through the vane passages.

* * * * *